US008651975B2

(12) United States Patent
Soracco

(10) Patent No.: US 8,651,975 B2
(45) **Date of Patent: *Feb. 18, 2014**

(54) GOLF CLUB HEAD WITH STIFFENING AND SOUND TUNING COMPOSITE MEMBER

(71) Applicant: Peter L. Soracco, Carlsbad, CA (US)

(72) Inventor: Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/739,325

(22) Filed: Jan. 11, 2013

(65) Prior Publication Data

US 2013/0130826 A1 May 23, 2013

Related U.S. Application Data

(63) Continuation of application No. 13/192,346, filed on Jul. 27, 2011, now Pat. No. 8,353,783, which is a continuation of application No. 12/334,563, filed on Dec. 15, 2008, now Pat. No. 8,007,369.

(51) Int. Cl.
*A63B 53/04* (2006.01)

(52) U.S. Cl.
USPC ..... 473/332; 473/345; 473/346; 473/349

(58) Field of Classification Search
USPC ..... 473/324–350, 287–292
See application file for complete search history.

(56) References Cited

U.S. PATENT DOCUMENTS

| | | | | |
|---|---|---|---|---|
| 3,143,349 | A | 8/1964 | MacIntyre et al. | |
| 3,847,399 | A | 11/1974 | Raymont | |
| 4,545,580 | A | 10/1985 | Tomita et al. | |
| 4,602,787 | A | 7/1986 | Sugioka et al. | |
| 4,681,322 | A | 7/1987 | Straza et al. | |
| 4,928,965 | A | 5/1990 | Yamaguchi et al. | |
| 4,928,972 | A | 5/1990 | Nakanishi et al. | |
| 4,930,781 | A | 6/1990 | Allen | |
| 5,083,778 | A | 1/1992 | Douglass | |
| 5,242,168 | A | 9/1993 | Aizawa | |
| 5,288,070 | A | 2/1994 | Chen | |
| 5,299,807 | A | 4/1994 | Hutin | |
| 5,316,298 | A * | 5/1994 | Hutin et al. | 473/332 |
| 5,316,305 | A | 5/1994 | McCabe | |
| 5,429,365 | A | 7/1995 | McKeighen | |
| 5,467,983 | A | 11/1995 | Chen | |
| 5,586,947 | A | 12/1996 | Hutin | |
| 5,669,827 | A | 9/1997 | Nagamoto | |
| 5,718,641 | A | 2/1998 | Lin | |
| 5,813,919 | A | 9/1998 | Best et al. | |
| 5,924,939 | A | 7/1999 | Grace et al. | |
| 5,935,017 | A | 8/1999 | Weaver et al. | |
| 5,944,620 | A | 8/1999 | Elmer | |
| 6,010,411 | A | 1/2000 | Reyes | |
| 6,045,456 | A | 4/2000 | Best et al. | |
| 6,152,833 | A | 11/2000 | Werner et al. | |
| 6,200,229 | B1 | 3/2001 | Grace et al. | |
| 6,299,547 | B1 | 10/2001 | Kosmatka | |

(Continued)

*Primary Examiner* — Sebastiano Passaniti
(74) *Attorney, Agent, or Firm* — Mark S. Leonardo; Brown Rudnick LLP

(57) ABSTRACT

A golf club head with sound tuning composite members forming at least a portion of the surface of the golf club head is disclosed herein. The composite members being a composite layer made out of a sandwiched core layer that is interposed inside the midsection of the composite member to provide vibration damping and sound tuning characteristics.

8 Claims, 12 Drawing Sheets

(56) References Cited

U.S. PATENT DOCUMENTS

| | | | | |
|---|---|---|---|---|
| 6,319,150 | B1 | 11/2001 | Werner et al. | |
| 6,332,848 | B1 | 12/2001 | Long et al. | |
| 6,368,231 | B1 | 4/2002 | Chen | |
| 6,443,854 | B1 | 9/2002 | Calboreanu | |
| 6,454,664 | B1 | 9/2002 | Long et al. | |
| 6,471,601 | B1 | 10/2002 | McCabe et al. | |
| 6,524,197 | B2 | 2/2003 | Boone | |
| 6,582,322 | B2 | 6/2003 | Long et al. | |
| 6,645,085 | B2 | 11/2003 | McCabe et al. | |
| 6,669,576 | B1 | 12/2003 | Rice | |
| 6,688,989 | B2 | 2/2004 | Best | |
| 6,699,140 | B1 | 3/2004 | Sun | |
| 6,776,725 | B1 | 8/2004 | Miura et al. | |
| 6,991,560 | B2 * | 1/2006 | Tseng | 473/332 |
| 8,007,369 | B2 * | 8/2011 | Soracco | 473/332 |
| 8,353,783 | B2 * | 1/2013 | Soracco | 473/332 |
| 2007/0049400 | A1 * | 3/2007 | Imamoto et al. | 473/329 |
| 2008/0132356 | A1 * | 6/2008 | Chao et al. | 473/350 |

* cited by examiner

GOLF CLUB HEAD WITH STIFFENING AND SOUND TUNING COMPOSITE MEMBER

CROSS-REFERENCE TO RELATED APPLICATIONS

This application is a continuation of U.S. patent application Ser. No. 13/192,346, filed Jul. 27, 2011, which is a continuation of U.S. patent application Ser. No. 12/334,563 filed Dec. 15, 2008, now U.S. Pat. No. 8,007,369. Both applications are incorporated herein by reference in their entireties.

FIELD OF THE INVENTION

The present invention relates to a golf club head with at least one composite member forming at least a portion of an outer surface of the golf club head, and more specifically a golf club head where the composite members is multi-layered with a sandwiched core layer interposed inside the composite member to provide one or more of the following: structural stiffness, vibration damping, and sound tuning for the golf club head.

BACKGROUND OF THE INVENTION

The complexities of golf club design are known. The specifications for each component of the club (i.e., the club head, shaft, grip, and subcomponents thereof) directly impact the performance of the club. Thus, by varying design specifications, a golf club can be tailored to have specific performance characteristics.

The design of club heads has long been studied. Among the more prominent considerations in club head design are loft, lie, face angle, horizontal face bulge, vertical face roll, center of gravity, rotational moment of inertia, material selection, overall head size, and overall head weight. While this basic set of criteria is generally the focus of golf club designers, other design aspects unrelated to performance such as sound of the club head upon impact with a ball must also be considered.

As the size of golf club heads has increased, weight distribution has become a major design consideration. In particular, in the quest to design in additional discretionary mass, it has become desirable to decrease the wall thicknesses of the portions of the club head wall that do not improve mass properties. Additionally, composite materials have also been used in the past to replace various sections of the club head walls to further improve weight distribution and generate discretionary mass. Because of the thin walls, composite materials, and the large volumes of the golf club head; large portions of the heads act as membranes and vibrate relative to each other. In some instances, the vibration that takes place could result in an unappealing sound during impact between the golf club and the golf ball.

Golfers have become accustomed to hearing a particular sound when the golf club impacts the golf ball, especially when a large volume golf club is used. This "ideal sound", although often a result of personal preference, can drastically turn into an unappealing sound if it varies too much from the above mentioned "ideal sound."

Various sound tuning features have been incorporated into hollow bodied golf clubs to try and capture and maintain this "ideal sound". One example is described in U.S. Pat. No. 6,852,038 to Yabu for a Golf Club Head and Method of Making the Same. In that example, a hollow body golf club head includes rib-like walls that form the inner surface of the sole and crown. The sound emitted into the hollow cavity due to contact with a golf ball is directed rearward and parted laterally by the ribs. Sound bars are included in some embodiments that are located a small distance behind the club face and extends between the crown and sole. The sound bars are included to further part the sound vibrations.

Another example is described in U.S. Pat. No. 5,718,641 to Lin for a Golf Club head that Makes a Sound when Striking the Ball. In that example, the golf club head includes a sound plate that is suspended in the hollow body of the club head that makes a sound and echoes the sound during impact between the club head and a golf ball. One edge of the sound plate is fixed to a wall of the hollow club head and the remaining edges are unattached so that the sound plate is able to vibrate to the remainder of the club head.

As an alternative to adding sound ribs or ridges, others have added features to golf club heads to improve rigidity of the club head by reducing relative vibration between opposing walls to reduce the energy that is waste din deforming the club head and to redirect that energy into the golf ball. For example, U.S. Pat. No. 6,524,197 to Boone for a Golf Club Head Having a Device for Resisting Expansion Between Opposing Walls During Ball Impact describes a feature designed for the above stated purpose. The golf club head includes a tensioning device that extends between the crown and sole. In particular, the tensioning device includes an elongated cylindrical member that extends through apertures in each of the crown and sole and enlarged ends that are unable to pass through the apertures. One of the enlarged heads is threaded so that a threaded end member may be used to tension the elongate cylindrical member thereby placing the hollow body in compression and increasing the rigidity of the hollow body.

It can be seen from above that despite numerous attempts to control the sound, the current art utilize heavy and burdensome objects such as ribs, ridges, panels, or even posts within the internal cavity of the golf club head to create structural stiffness, control vibration damping, and adjust the sound. The additions of these heavy and burdensome objects are undesirable not only because they are expensive to manufacture, but they could also add additional weight to the golf club head at locations that may not be desirable for performance optimization.

Hence, it can be seen that there is a need in the field for a golf club head that is capable of controlling the sound characteristics without heavy and burdensome objects inserted into the internal cavity of the golf club head. More specifically, there is a need for a golf club head that utilizes the pre-existing performance optimization components such as a composite member, and modifying the internal composition of the composite member to provide structural stiffness, vibration damping, and sound tuning characteristics.

BRIEF SUMMARY OF THE INVENTION

In one aspect of the present invention, a golf club head comprising of a hitting face providing a surface area for striking a golf ball, a body section including a crown section and a sole section and extending from a rear section of the hitting face, and a composite member forming at least a portion of the surface of the golf club head; wherein the composite member further comprises of a sandwiching outer layer, a sandwiching inner layer, and a sandwiched core layer interposed between the sandwiching outer layer and the sandwiching inner layer; wherein the sandwiched core layer is of a different material composition than the sandwiching outer layer and the sandwiching inner layer, and wherein said golf club head has a volume ranging from 350 cubic centimeters to 495 cubic centimeters; and wherein said golf club head has a length ranging from 3.5 inches to 5.0 inches and a width ranging from 4.0 inches to 5.0 inches.

In another aspect of the present invention, a golf club head comprising of a hitting face providing a surface area for striking a ball, a body section including a crown section and a sole section and extending from a rear section of the hitting face, and a composite member forming at least a portion of the surface of the golf club head; wherein the composite member further comprises of a sandwiching outer layer, a sandwiching inner layer, and a sandwiched core layer comprising of a vibration damping material interposed between the sandwiching outer layer and the sandwiching inner layer; wherein said golf club head has a volume ranging from 350 cubic centimeters to 495 cubic centimeters; and wherein said golf club head has a length ranging from 3.5 inches to 5.0 inches and a width ranging from 4.0 inches to 5.0 inches.

In another aspect of the present invention, a method of altering sound of a golf club head comprising of connecting a body section to the rear section of the golf club head, replacing at least a portion of the surface of the body section with a composite member; wherein the composite member is comprising of a sandwiching outer layer at an external surface of the golf club head, and a sandwiching inner layer at an internal surface of the golf club head, interposing a vibration damping material between the sandwiching outer layer and the sandwiching inner layer.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below and can each be used independently of one another or in combination with other features. However, any single inventive feature may not address any or all of the problems discussed above or may only address one of the problems discussed above. Further, one or more of the problems discussed above may not be fully addressed by any of the features described below.

The present invention generally provides a golf club head with stiffening and sound tuning capabilities and characteristics. More specifically, the present invention utilizes a golf club head that is comprised of two or more materials and utilizing an already existent composite member that forms at least a portion of the surface of the golf club head to provide stiffening and sound tuning characteristics. Even more specifically, the current invention may include a sandwiched core layer interposed in the middle between multilayer composite members that form the composite member to directly provide stiffness within the golf club head. Sound characteristics may be dramatically improved through a combination of engineered dampening systems and a tailored variation in structural stiffness. The current invention is unlike the prior art golf club heads wherein heavy, burdensome, expensive, and complicated components are installed within the internal cavity of the golf club head to provide stiffness to address the vibration and sound issue. The current invention utilizes pre-existing composite members within a golf club head that was traditionally used for weight saving purposes, and adds an additional stiffening and vibration damping layer directly within the composite member to improve sound tuning characteristics.

Every golf club produces a distinct sound and feels when it is used to strike a golf ball. The sound and feel which are produced by the vibration behavior of the golf club head, may often be a result of the design of the golf club head. Golf club head designs may be analyzed and samples may be tested to characterize the vibration characteristics of a particular design in an attempt to determine whether the sound and feel produced by a golf club head will be acceptable to the average golfer. In particular, the frequency values and displacement mode shapes are determined for the club head. It is generally understood that lower frequency modes have a tendency to detrimentally affect the sounds and feel of a particular golf club head.

Figure 1:
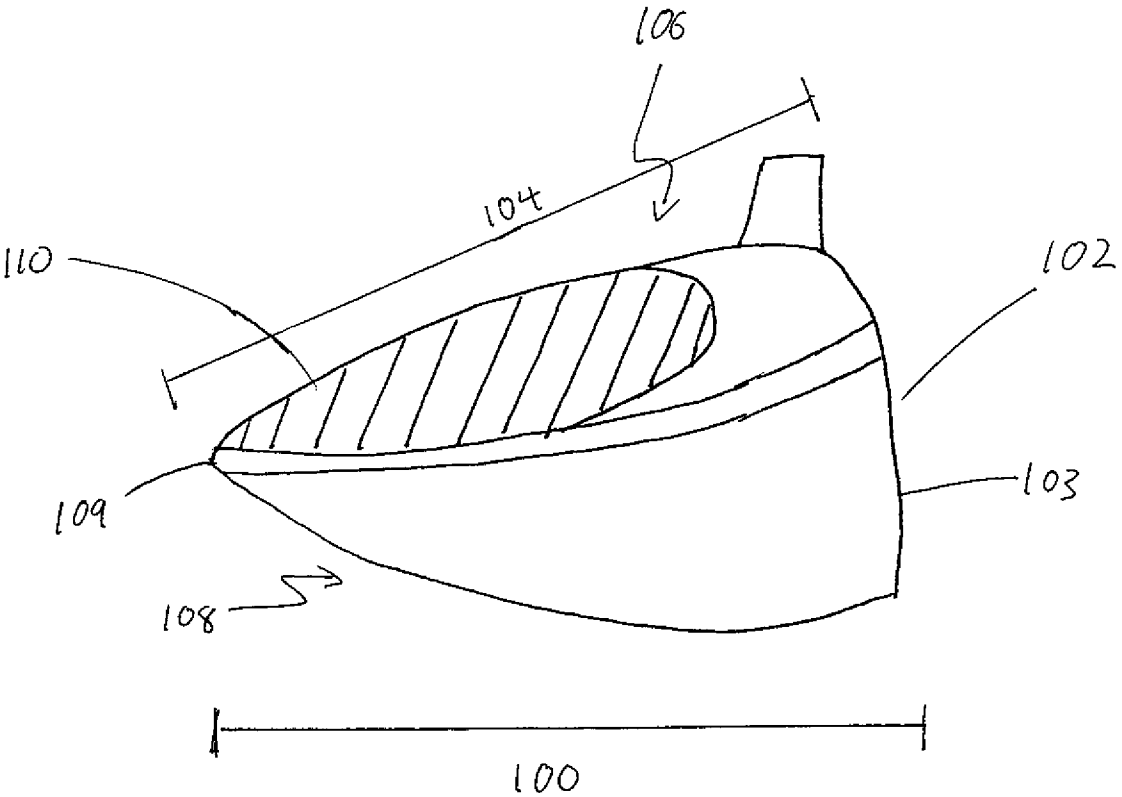
FIG. 1 shows a side profile view of one embodiment of the present invention wherein the composite member is located at the crown.

FIG. 1 shows a side view of one embodiment of the present invention showing golf club head 100 which may contain a hitting face 102 at a fore section of golf club head 100 wherein a surface area is provided for striking a ball. In this current exemplary embodiment, golf club head 100 may contain a face insert 103 to further provide an area for striking the ball; however, hitting face 102 may also can be a unitary component without departing from the scope of the present invention. Connected to the rear section of hitting face 102 is a body section 104 which may comprise of a crown section 106, a sole section 108, and a skirt section 109. It should be noted that in an alternative embodiment, skirt section 109 could often be classified as part of the crown section 106 or part of the sole section 108 all without departing from the scope of the present invention. Here, as shown in FIG. 1 of the current exemplary embodiment, golf club head 100 may have a composite member 110 connected to a crown section 106 of the body section 104 to provide stiffening and vibration damping to golf club head 100.

FIG. 1 also shows that in the current exemplary embodiment, the composite member 110 may generally be made out of a different material than the remainder of the body section 104 of the golf club head 100. "Composite member" 110 as described in this current exemplary embodiment may generally be made out of a composite material that is different than the remainder of the body section 104. This composite member may offer weight saving capabilities by changing the material to different materials that provides weight saving capabilities all within the scope of the present invention.

Golf club head 100, here in this current exemplary embodiment, may have a preferable volume range of approximately 300 cubic centimeters to approximately 600 cubic centimeters, and more preferably in the volume range of approximately 350 cubic centimeters to approximately 550 cubic centimeters, even more preferably in the volume range of approximately 375 cubic centimeters to approximately 475 cubic centimeters, and most preferably approximately 420 cubic centimeters to approximately 460 cubic centimeters; all without departing from the scope of the present invention.

The mass of golf club head 100 of the present invention ranges from 165 grams to 250 grams, preferably ranges from 175 grams to 230 grams, and more preferably from 190 grams to 210 grams. More specifically, face insert 103, as shown in the present exemplary embodiment may have a weight of approximately 20 grams to approximately 60 grams, preferably ranging from approximately 30 grams to approximately 50 grams, and more preferably from approximately 35 grams to approximately 45 grams. Additionally, the body section 104, as shown in the present exemplary embodiment may have a weight of approximately 115 grams to approximately 145 grams, preferably ranging from approximately 120 grams to approximately 140 grams, and more preferably from approximately 125 grams to approximately 135 grams.

Golf club head 100 in this current exemplary embodiment may have a preferred length range of approximately 3.5 inches to 5.0 inches measuring from the face of the club towards the skirt of the club in accordance with USGA definitions; more preferably 4.0 inches to 5.0 inches, and most preferably 4.5 inches to 5.0 inches. Additionally golf club head 100 may have a preferred width range of approximately 4.0 inches to 5.0 inches measuring from the widest part of the heel to the widest part of the sole in accordance with USGA definitions; more preferably 4.5 inches to 5.0 inches.

Hitting face 102 in this current exemplary embodiment is generally made out of a metallic material, and generally placed at the fore section of golf club head 100 for contact with a golf ball. Hitting face 102 may generally be made out of titanium alloy materials for their performance characteristics when in contact with a golf ball, however numerous other materials other than titanium alloy may also be used without departing from the scope of the present invention. The face insert 103 may generally have the same consistent material as the remainder of hitting face 102; however, face insert 103 may be made out of a different material such as a heat treated 6-20-20 titanium alloy or any other material capable of providing a serviceable striking area without departing from the scope of the present invention.

Figure 2:
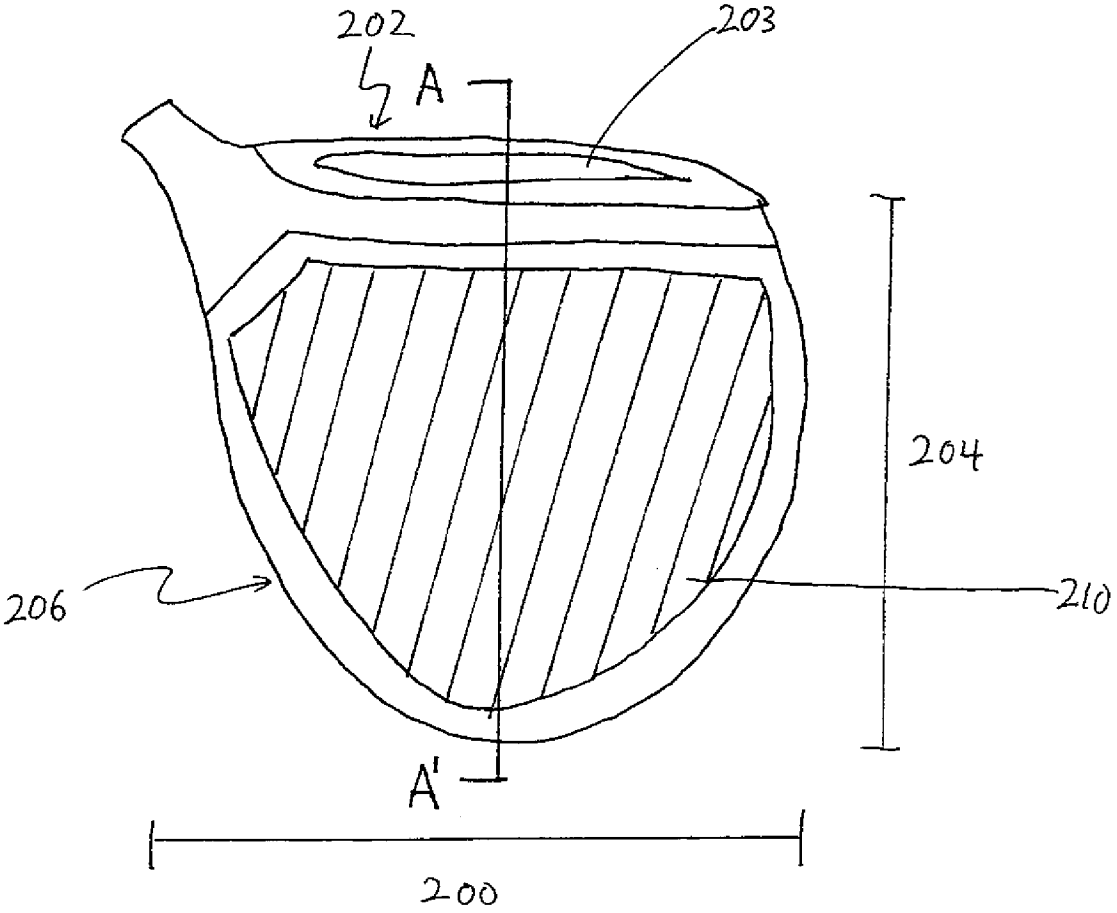
FIG. 2 shows a top view of the embodiment of the present invention as shown in FIG. 1.

FIG. 2 shows a top view of golf club head 200 in accordance with an embodiment of the present invention. The top view of golf club head 200, as shown in the current exemplary embodiment, shows the composite member 210 covering the majority of the crown section 206. This arrangement of the composite member 210 allows for increased weight shifting from the crown section 206 and creates the increased amount of discretionary weight. However, nonmetallic member 210 may only be a minor part of the crown section 206 without departing from the scope of the present invention.

Figure 3:
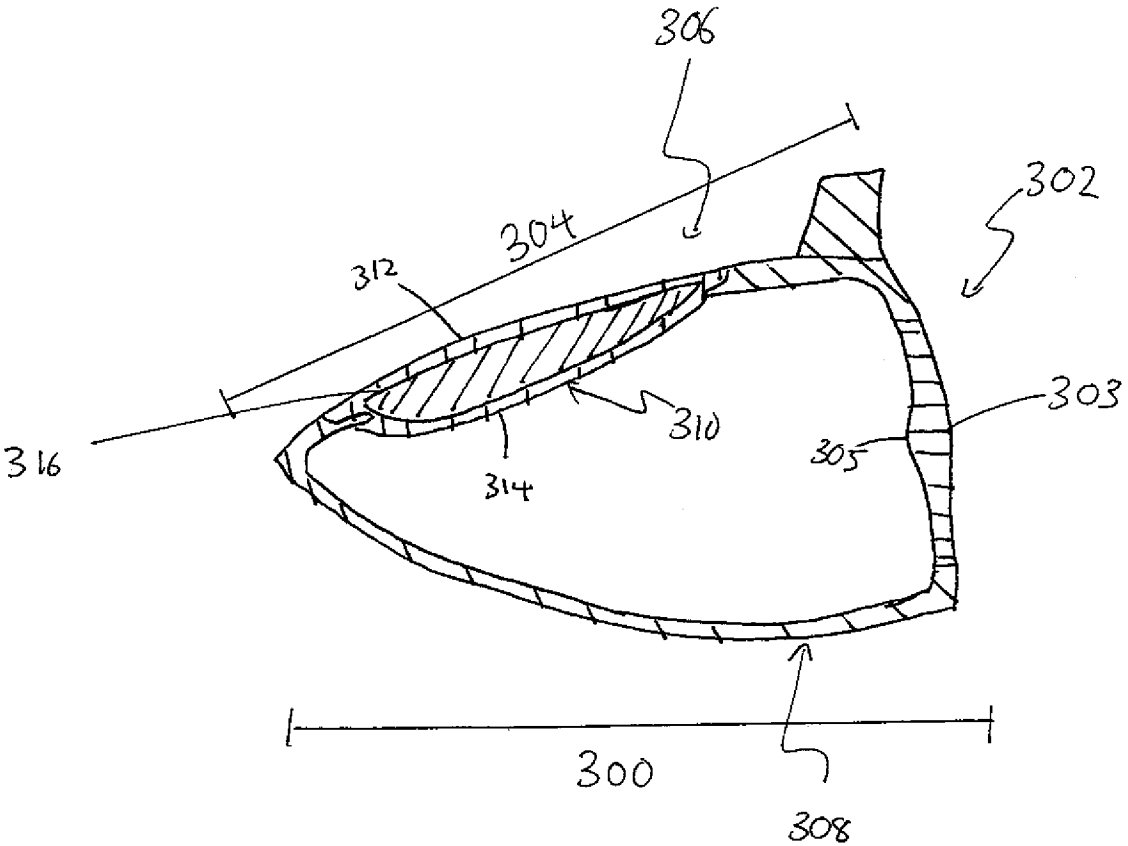
FIG. 3 shows a cross-sectional view of the embodiment of the present invention as shown in FIG. 2 taken along line A-A.

Turning now to FIG. 3 showing a cross-sectional view of the exemplary embodiment of the present invention taken along the middle of golf club head 200 as depicted by line A-A' in FIG. 2. The cross-sectional view of the current exemplary embodiment shows that the composite member 310 may be further comprised of a sandwiching outer layer 312 at a top outer surface of the composite member 310, a sandwiching inner layer 314 at a bottom inner surface of the composite member 310, and a sandwiched core layer 316 interposed between the sandwiching outer layer 312 and the sandwiching inner layer 314. The sandwiched core layer 316, as shown in the current exemplary embodiment may further provide structural rigidity to composite member 310, which in turn may also provide vibration damping to improve sound.

Body section 304 in this current exemplary embodiment may generally be comprised of a crown section 306 and a sole section 308. In alternative embodiments, body section 304 could contain various other components such as a skirt section, a toe section, a heel section, or any other section not defined as a hitting face 302 all without departing from the scope of the present invention. The crown section 306 and sole section 308 form the upper and lower surfaces, respectively, of body section 304. Additionally, body section 304 generally provides the majority of the surface area of golf club head 300. In order to maintain the large volume of modern golf club heads while providing maximum discretionary mass, crown section 306 and sole section 308 tend to have relatively thin walls, which results in those portions often acting as a vibrating membrane during and after impact with the golf ball. Crown section 306 and sole section 308 may be spaced apart from each other, and they combine to form the body section 304 with or without any further subcomponents such as a skirt section, a toe section, and a heel section; all without departing from the scope of the present invention.

The cross-sectional view of golf club head 300 allows the variable thickness feature of face insert 303 to be shown. Here, hitting face 302 may contain a variable face thickness section 305 within the face insert 303 as shown by U.S. Pat. Pub. 2006/0068932 the disclosure of which is incorporated by reference in its entirety; however, hitting face 302 could also be of a uniform thickness or even without a face insert all without departing from the scope of the present invention.

Body section 304 in this current exemplary embodiment may generally consist of a metallic member of the golf club head 300 and a composite member 310 of golf club head 300 that is of a different material than the remainder of the body section 304. Metallic member of golf club head 300 may generally be used to provide structural rigidity and a solid feel to golf club head 300, and the composite members 310 are generally used for weight saving purposes; however, it should be noted that the entire body section 304 may be made out of a composite member 310 to achieve the same objective of weight shifting without departing from the scope and content of the present invention. As indicated previously, in order to create even more discretionary weight, more and more components of body section 304 may be replaced with composite member 310 without departing from the scope of the present invention. As shown in the current exemplary embodiment in FIG. 3, composite member 310 may be used to replace a crown section 306 of the golf club head 300 or in an alternative embodiment, composite member 310 could also be used to replace the sole section 308, the skirt section, a toe section, a heel section, or any other sections of body section 304 all without departing from the scope of the present invention.

FIG. 3 also shows the composite member 310 filling in the area of golf club head 300 that is not made out of the metallic material. Put in another way, the composite member 310 fills in gaps in the external wall of golf club head 300 that is not made out of a metallic material. However, composite member 310 can also work in conjunction with metallic member to form a dual layer golf club head 300 to contain an overlapping profile that achieves the same sound tuning characteristic without departing from the scope of the present invention. Composite member 310, as shown in this current exemplary embodiment provides a majority of the surface area of golf club head 300 via body section 304; however composite member 310 may also be strategically placed at various locations of golf club head 300 without providing a majority of the surface area of golf club head 300 without departing from the scope of the present invention.

Composite member 310 may be further comprised of a sandwiching outer layer 312, a sandwiching inner layer 314, and a sandwiched core layer 316. It should be noted that even though sandwiching outer layer 312 and the sandwiching inner layer 314 are separated by a sandwiched core layer 316, they may generally be made out of the same material; however, sandwiching outer layer 312 and sandwiching inner layer 314 may be made out of different materials with different characteristic without departing from the scope of the present invention. Sandwiching outer layer 312 and sandwiching inner layer 314 could be comprised of various different polymers such as plies of pre-preg material, thermoplastic materials such as polyurethanes, polyesters, polyamides, ionomers, continuous fiber pre-preg material, injection molded plastic, bucky paper, or any other similar material that has a lighter weight without departing from the scope of the present invention. Alternatively, sandwiching outer layer 312 and sandwiching inner layer 314 may also be comprised of metallic materials such as aluminum, titanium, magnesium, or any other metallic material that is lightweight without departing from the scope of the present invention. In a preferred embodiment, the sandwiching outer layer 312 and sandwiching inner layer 314 may be made out of carbon fiber due to its high strength and weight saving qualities.

Sandwiched core layer 316, as shown in the current exemplary embodiment contains a thickness profile that may bulge into the internal cavity of golf club head 300 to increase the area and volume of sandwiched core layer 316, hence allowing an increase stiffness and vibration damping. However, it is worth noting that sandwiched core layer 316 may contain a thickness profile that is uniform in thickness within the entire range of composite member 310, bulges out away from the external surface of golf club head 300, or any other thickness profile that is capable of providing structural stiffness and vibration damping without departing from the scope of the present invention.

Sandwiched core layer 316, as shown in the current exemplary embodiment may generally be made out of various different materials ranging from plastic polymer, aluminum polymer, foam, resin impregnated paper, balsa wood, bucky paper, filled vinyl polymer, visco elastic polymer, rubber, or any type or material that is of a low density and has substantial compressibility such that it can withstand the manufacturing process without collapsing all without departing from the scope of the present invention. Sandwiched core layer 316 could also be in various different shapes such as a honeycomb hexagonal shape, trapezoidal shape, triangular shape, pyramidal shape, conic shape, cylindrical shape, spherical shape, rhombus shape, or any other shape that is capable of providing increased structural stiffness while minimizing density and weight of golf club head 300 all without departing from the scope of the present invention.

Sandwiched core layer 316, as shown in the current exemplary embodiment may generally be comprised of a lightweight material to create discretionary weight; however, sandwiched core layer 316 may also be a dense heavy material that allows specific weights to be placed at various locations of golf club head 300 without the need for alternative attachment means without departing from the scope and content of the present invention.

It should also be noted here that although sandwiched core layer 316 may often be capable of adding structural stiffness, sandwiched core layer 316 may also serve a purely vibration damping purpose that does not enhance structural stiffness without departing from the scope of the present invention. For example, sandwiched core layer 316 could also be of a foam type material, cotton type material, or any other material capable of absorbing vibration damping without adding structural stiffness all without departing from the scope of the present invention.

The current invention may achieve improved sound characteristics by increasing structural stiffness in two ways utilizing the composite member 310. First, the separation of sandwiching outer layer 312 and the sandwiching inner layer 314 helps achieve increased structural inertia, which in turn increases the stiffness of the material. Because the structural inertia of a composite material increases with the separation of the structural material, just by separating sandwiching outer layer 312 from sandwiching inner layer 314 alone, the structural stiffness of composite member 310 increases. Secondly, sandwiched core layer 316 could also increase structural stiffness either through its physical properties or through geometric shapes such as a honeycomb mentioned above. By interposing a sandwiched core layer 316 between sandwiching outer layer 312 and sandwiching inner layer 314, the composite member 310 achieves significant improvement in structural stiffness in at least the two methods mentioned above.

Figure 4:
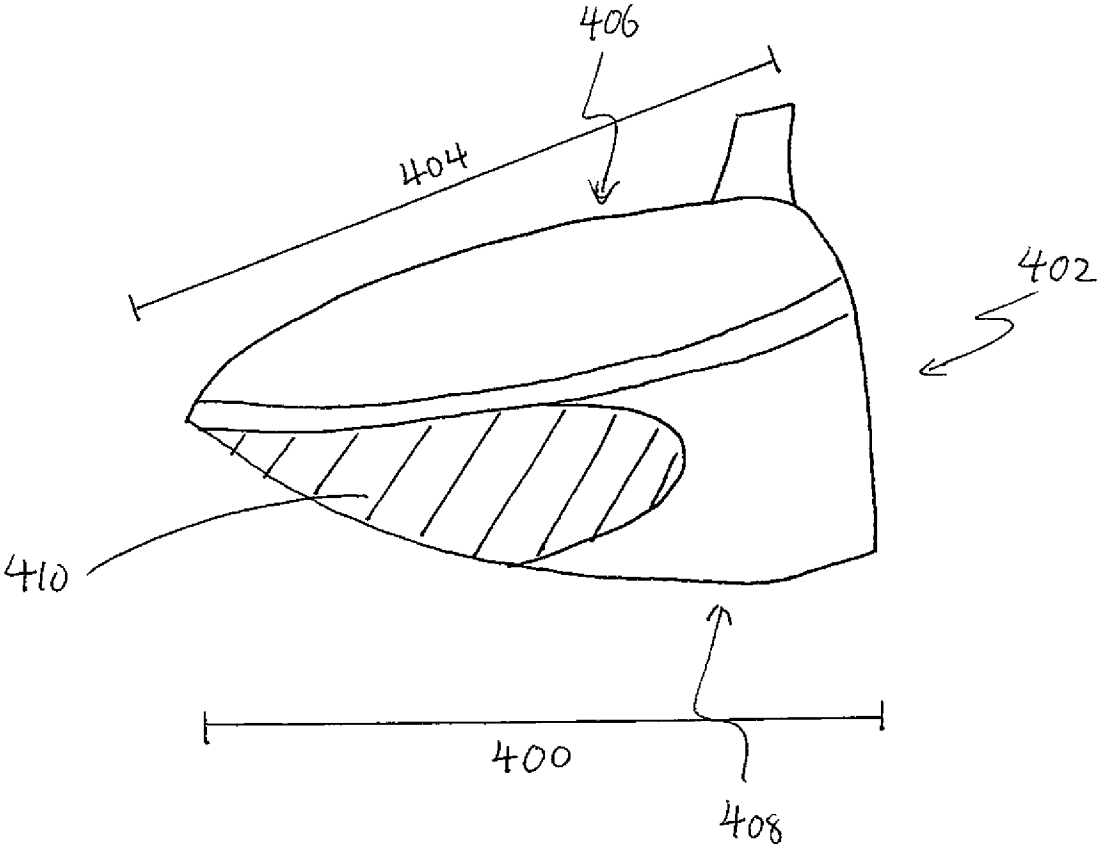
FIG. 4 shows an alternative embodiment of the present invention wherein the composite member is located at the sole.

FIG. 4 shows a side view of an alternative embodiment of a golf club head 400 in accordance with the present invention wherein the composite member 410 is placed at the sole section 408 of golf club head 400. This alternative embodiment, as described above, may be used to provide structural stiffness at the sole section 408 or provide sound tuning at the sole section 408 of the golf club head 400.

Figure 5:
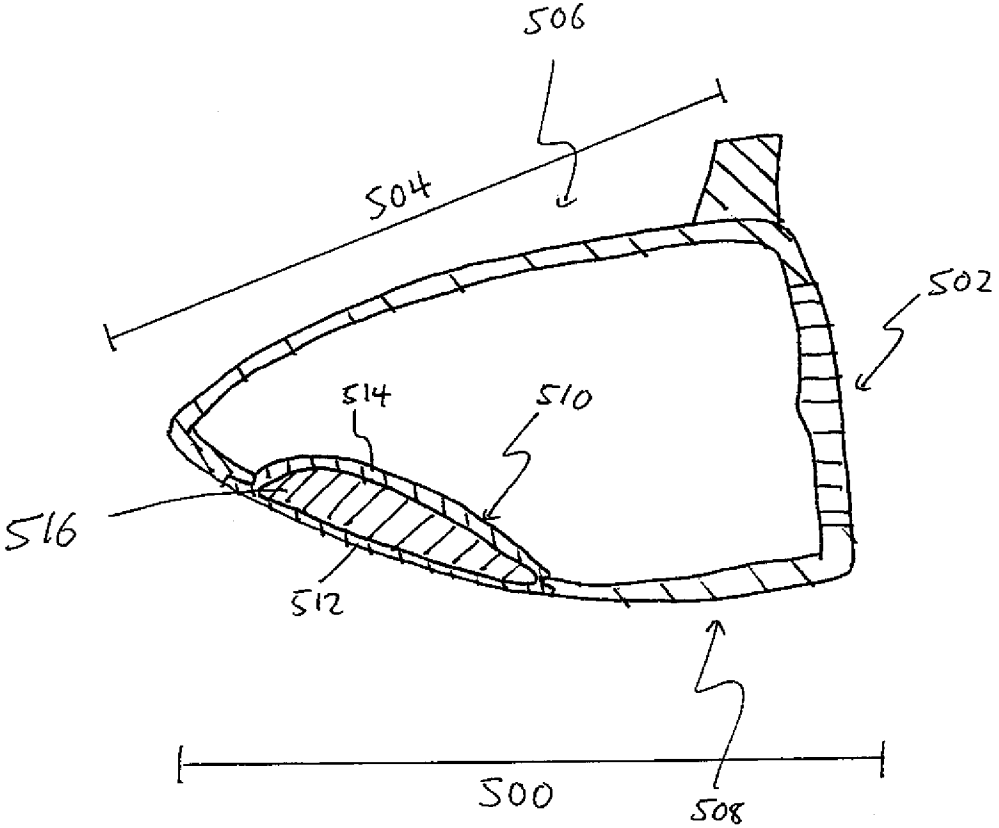
FIG. 5 shows a cross-sectional view of an alternative embodiment of the present invention as shown in FIG. 4, taken along the midsection similar to line A-A.

FIG. 5 shoes a cross-sectional view of the alternative embodiment of the present invention as shown in FIG. 4, wherein the composite member 510 is placed at the sole section of golf club head 500. Similar to the cross sectional view presented in FIG. 3, the current alternative embodiment shows a sandwiching outer layer 512, a sandwiching inner layer 514, and a sandwiched core layer 516 interposed between the sandwiching outer layer 512 and a sandwiching inner layer 514. These layers may contain the same characteristics as those described in FIG. 3, but placed at the sole section 508 also to achieve sound tuning and stiffening of golf club head 500.

Figure 6:
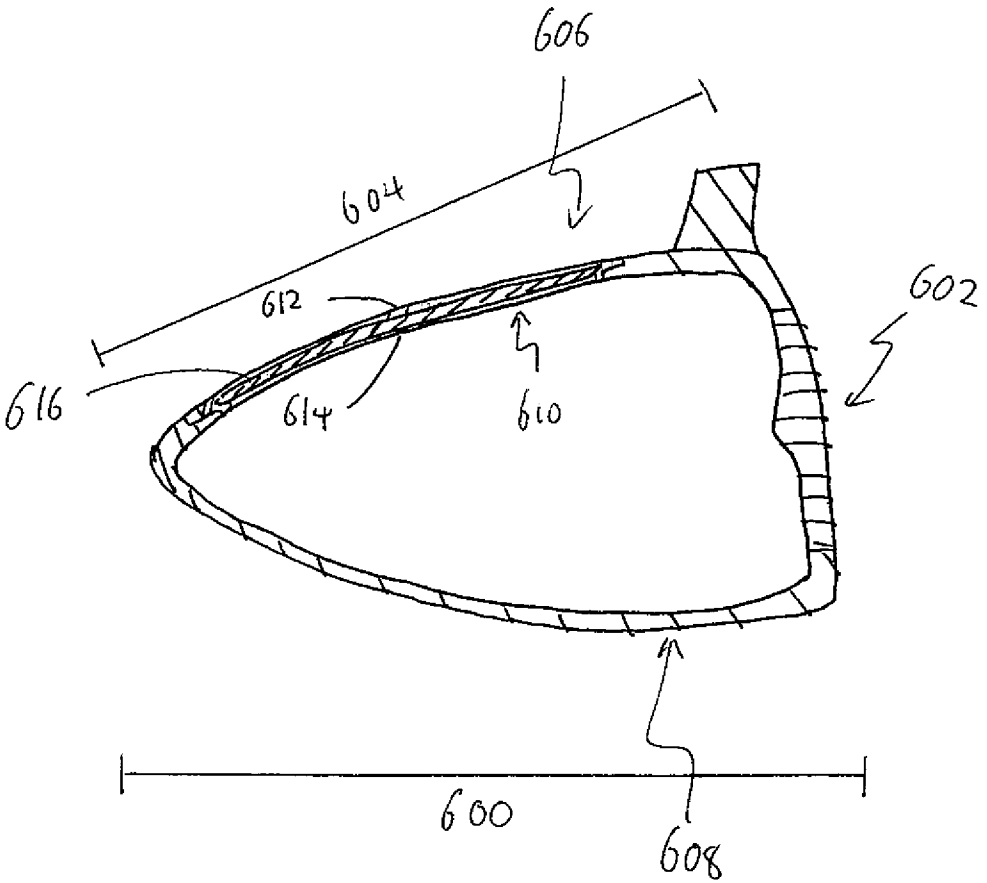
FIG. 6 shows a cross-sectional view of a further alternative embodiment of the present invention taken along the midsection similar to line A-A', wherein the composite member has a different profile.

FIG. 6 shows a cross-sectional view of a golf club head 600 in accordance with a further alternative embodiment of the present invention wherein the composite member 610 may contain a sandwiched core layer 616 with a uniform thickness profile interposed between sandwiching outer layer 612 and sandwiching inner layer 614. It should be noted that although FIG. 6 depicts this further alternative embodiment to have the composite member 610 in the crown section 606, the composite member 610 may be placed at the sole section 608, the skirt section, the heel section, the toe section, or any other section within golf club head 600 all without departing from the scope of the present invention.

Figure 7:
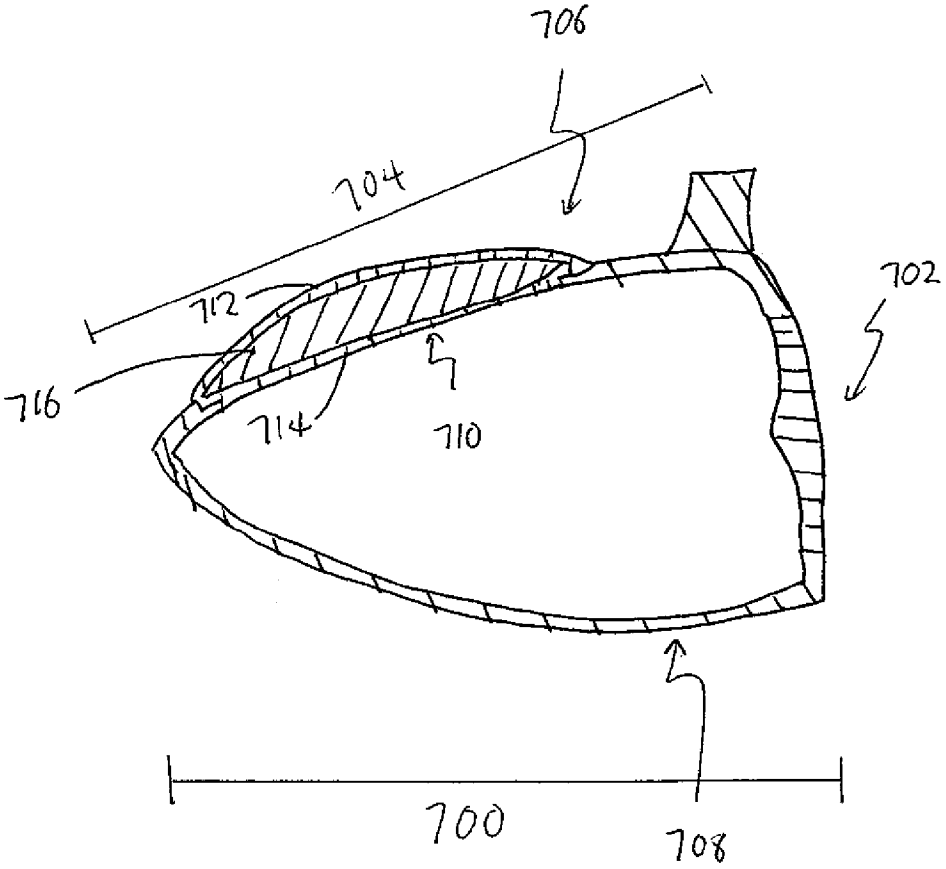
FIG. 7 shows a cross-sectional view of a further alternative embodiment of the present invention taken along the midsection similar to line A-A', wherein the composite member has a different profile.

FIG. 7 shows a cross-sectional view of a golf club head 700 in accordance with a further alternative embodiment of the present invention wherein the composite member 710 may contain a sandwiched core layer 716 with thickness profile that bulges out away from golf club head 700, and interposed between sandwiching outer layer 712 and sandwiching inner layer 714. It should be noted that although FIG. 7 depicts this further alternative embodiment to have the composite member 710 in the crown section 706, the composite member 710 may be placed at the sole section 708, the skirt section, the heel section, the toe section, or any other section within golf club head 700 all without departing from the scope of the present invention.

Figure 8:
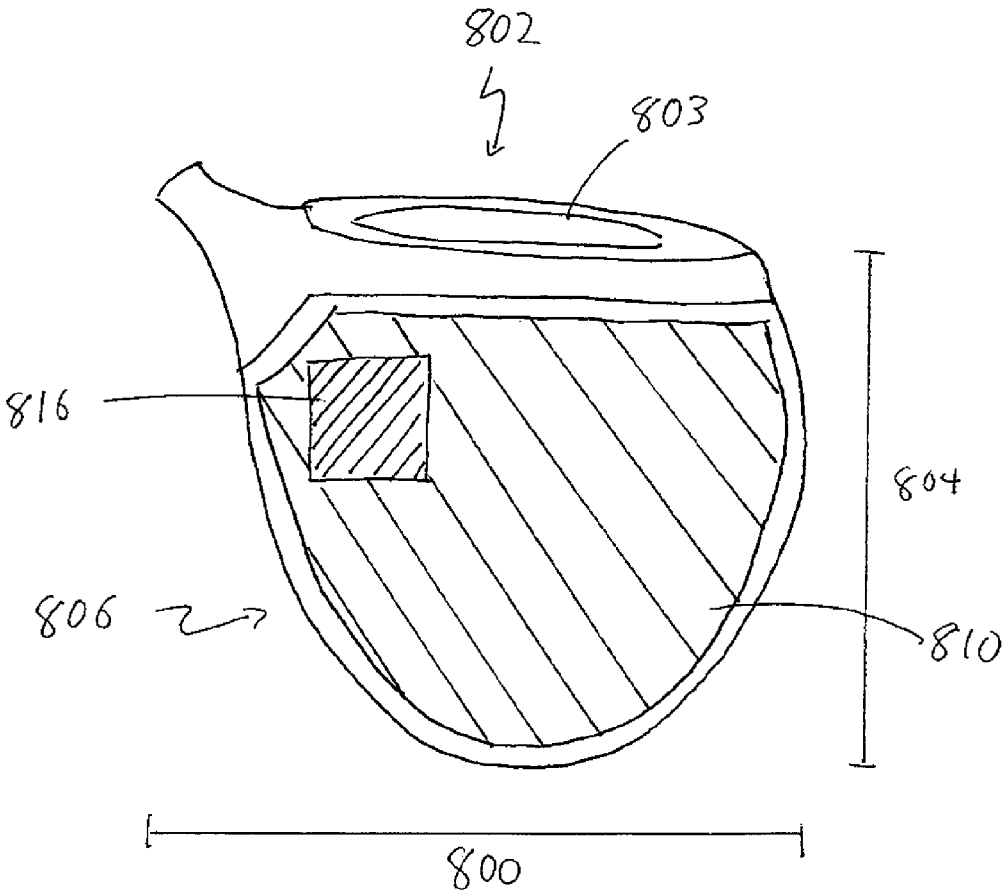
FIG. 8 shows a top view of a further alternative embodiment of the present invention, wherein the composite member has a different profile.

FIG. 8 shows a top view of a further alternative embodiment of the present invention wherein although the composite member 810 covers a majority of the crown section 806, the sandwiched core layer 816 interposed inside the composite member 810 may only occupy a partial section of composite member 810. Sandwiched core layer 816 may be placed in a way that strategically occupies a location that coincides with the vibration damping needs of a golf club head 800 upon impact with a golf ball. Once again, it should be noted that although in FIG. 8, the composite member 810 is located in the crown section 806, the composite member 810 may be placed at the sole section, the skirt section, the heel section, the toe section or any other section with golf club head 800 all without departing from the scope of the present invention. The sandwiched core layer 816 in this current exemplary embodiment may be placed at the crown section 806 near the hosel of golf club head 800; however, sandwiched core layer 816 may also be placed toward the toe section, the leading edge, the trailing edge, on the crown, on the sole, on the skirt, or any other location on golf club head 800 that needs vibration damping all without departing from the scope of the present invention. Finally, although third section 816 may be square in shape in FIG. 8, third section 816 may be rectangular in shape, circular in shape, triangular shape, trapezoidal in shape, octagonal in shape, criss cross in shape, or any other shape that is capable of addressing the vibration damping needs of golf club head 800 without departing from the scope of the present invention.

Figure 9:
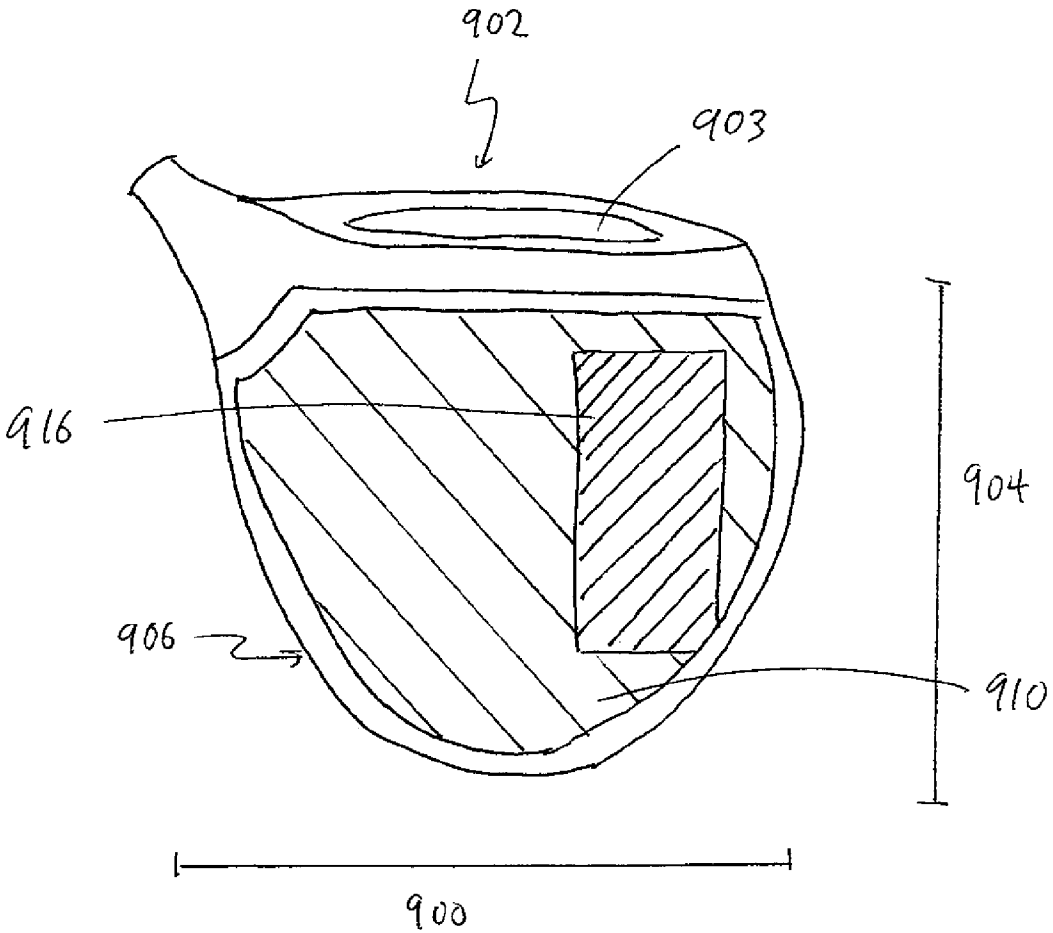
FIG. 9 shows a top view of a further alternative embodiment of the present invention wherein the composite member has a different profile.

FIG. 9 shows a top view of a further alternative embodiment of the present invention wherein the sandwiched core layer 916 interposed inside the composite member 910 takes on a rectangular shape at a different location on golf club head 900. This alternative embodiment of golf club head 900 identifies another potential location within golf club head 900 wherein vibration damping coincides with the sound improvement needs of golf club head 900 when it comes in contact with a golf ball. Sandwiched core layer 916 may also be placed toward the toe section, the leading edge, the trailing edge, on the crown, on the sole, on the skirt, or any other location on golf club head 900 that needs vibration damping all without departing from the scope of the present invention.

Figure 10:
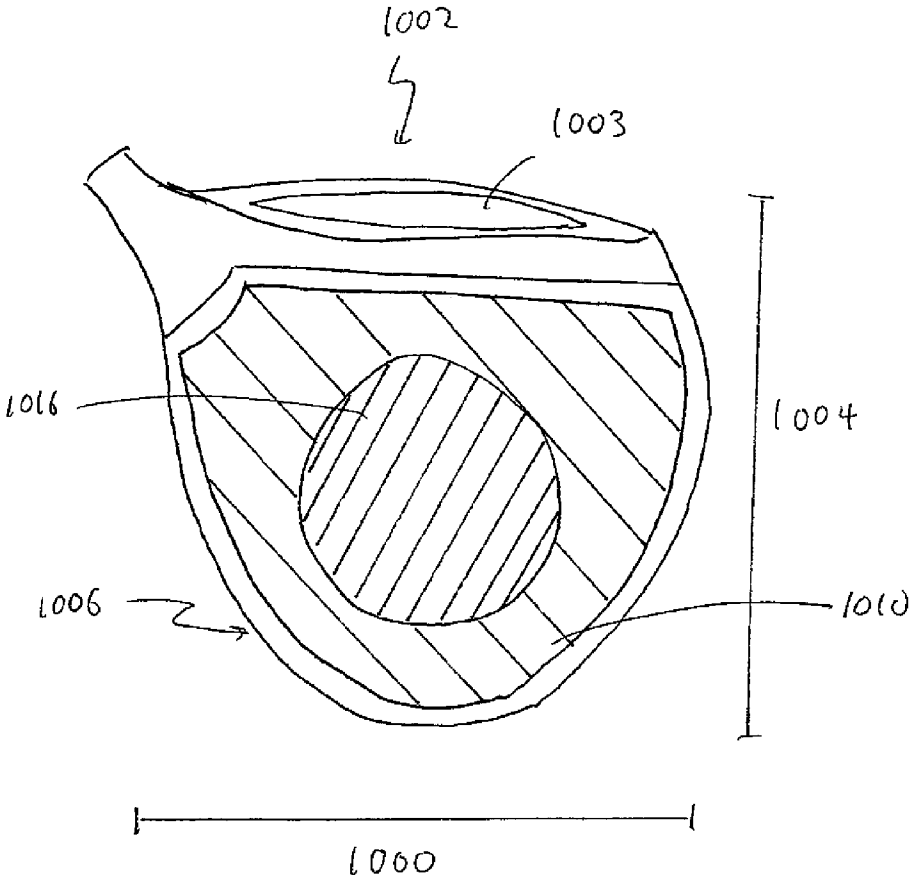
FIG. 10 shows a top view of a further alternative embodiment of the present invention wherein the composite member has a different profile.

FIG. 10 shows a top view of a further alternative embodiment of the present invention wherein the sandwiched core layer 1016 interposed inside the composite member 1010 takes on a circular shape at a different location on golf club head 1000. This alternative embodiment of golf club head 1000 identifies another potential location within golf club head 1000 wherein vibration damping could be needed when golf club head 1000 comes in contact with a golf ball. Sandwiched core layer 1016 may also be placed toward the toe section, the leading edge, the trailing edge, on the crown, on the sole, on the skirt, or any other location on golf club head 1000 that needs vibration damping all without departing from the scope of the present invention.

Figure 11:
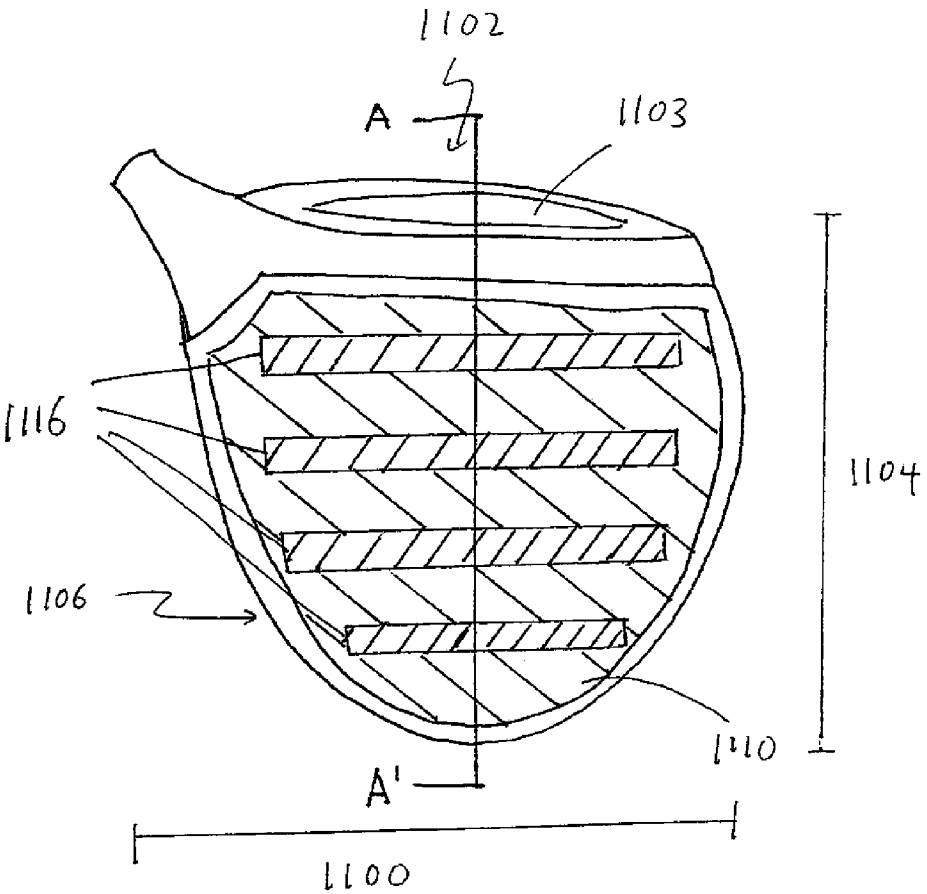
FIG. 11 shows a top view of a further alternative embodiment of the present invention wherein the composite member has a different profile.

FIG. 11 shows a top view of a further alternative embodiment of the present invention wherein the sandwiched core layer 1116 interposed inside composite member 1110 takes on a multiple elongated rectangular shape at various different locations on golf club head 1100. This alternative embodiment of golf club head 1100 allows multiple sandwiched core layers 1116 to be interposed inside composite member 1110 to provide vibration damping at multiple locations within golf club head 1100. Sandwiched core layer 1116 may also be placed toward the toe section, the leading edge, the trailing edge, on the crown, on the sole, on the skirt, or any other location on golf club head 1100 that needs vibration damping all without departing from the scope of the present invention.

Figure 12:
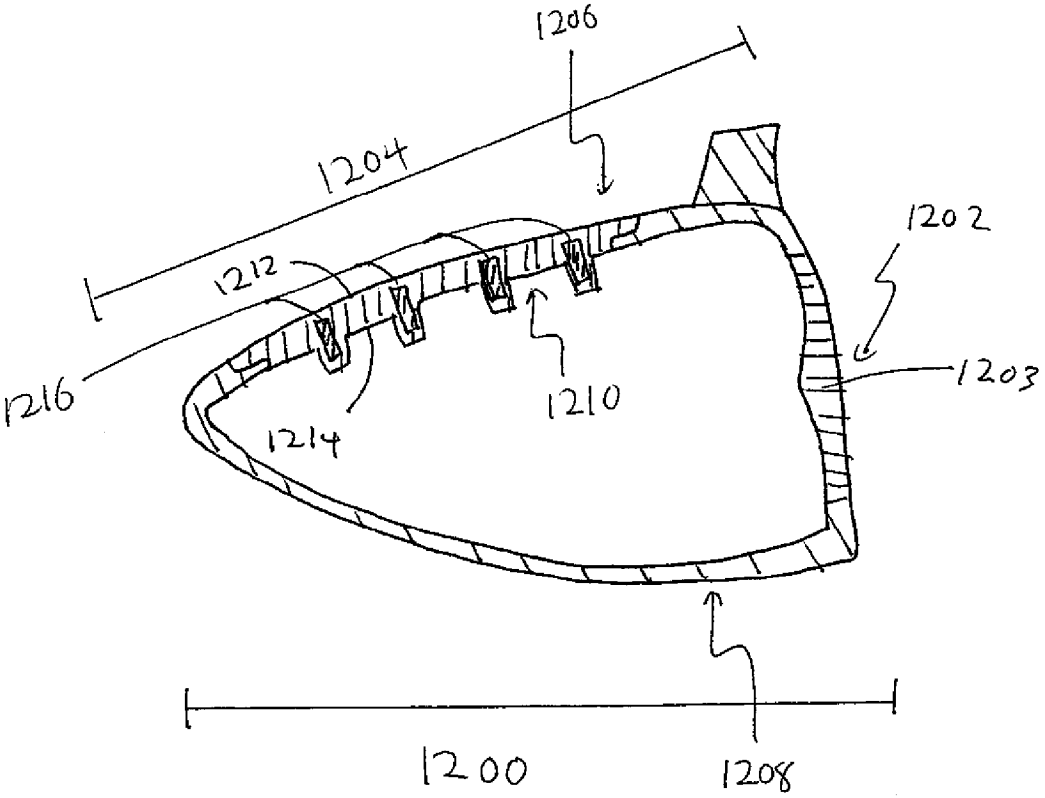
FIG. 12 shows a cross-sectional side view of a further alternative embodiment of the present invention taken along A-A' as shown in FIG. 11.

FIG. 12 shows a cross-sectional view of a further embodiment of the present invention taken along the middle of golf club head 1100 as depicted by line A-A' in FIG. 11. Similar to golf club head 1100, golf club head 1200 has multiple sandwiched core layers 1216 interposed inside composite member 1210, between sandwiching outer layer 1212 and sandwiching inner layer 1214. FIG. 12 demonstrates that the sandwiched core layers 1216 protrude into the cavity of the golf club head 1200; however, as illustrated above, sandwiched core layers 1216 may have a uniform thickness within composite member 1210, or even protrude out of golf club head 1200 all without departing from the scope of the present invention. Finally, although sandwiched core layers 1216 in this current exemplary embodiment may be shown as a uniform material, sandwiched core layers 1216 may be comprised of dual materials, or even multiple materials to address the various strengthening and vibration dampening needs of sandwiched core layers 1216 all without departing from the scope of the present invention.

As shown in the aforementioned various figures, a preferred embodiment of the present invention utilizes structural stiffness and vibration damping to control the sound characteristics of a golf club head when it comes in contact with a golf ball. Given a golf club swing speed of approximately 80 miles per hour ("MPH") to approximately 130 MPH, a golf club head could potentially reach amplitude of 125 decibels ("dB") when measured at a distance of 1 foot. However, a golf club in accordance with the present invention, given the same swing speed, may yield an amplitude level less than approximately 125 dB, preferably of an amplitude level of less than approximately 120 dB, and even more preferably an amplitude level of less than approximately 110 dB, and more preferably an amplitude level of less than approximately 100 dB.

Although amplitude is an important characteristic of sound, a preferred embodiment of the present invention that utilizes structural stiffness and vibration damping will also be able to control the frequency of a golf club head when it comes in contact with a golf ball. Given a golf club swing speed of approximately 80 MPH to approximately 130 MPH, a golf club head in accordance with the present invention may yield a frequency greater than approximately 2500 hertz ("Hz"), preferably of a frequency greater than approximately 3000 Hz, and more preferably greater than approximately 3500 Hz. A further discussion of the frequency values associated with reduction in noise can also be found in U.S. Pat. No. 7,297,072, the disclosure of which is incorporated by reference in its entirety.

It should be understood, of course, that the foregoing relates to exemplary embodiments of the invention and that modifications may be made without departing from the scope and content of the invention as set forth in the following claims.

The invention claimed is:

1. A golf club head comprising:

a hitting face providing a surface for striking a golf ball;

a body section including a crown section and a sole section, the body section extending from said hitting face, the hitting face, crown section, and sole sections forming an interior cavity of the club head, the body section comprising a body material and a composite material, wherein the composite material comprises multiple sandwiched core layers, and wherein the composite material is interposed inside a gap within the body material.

2. The golf club head of claim 1, wherein the body material comprises carbon fiber.

3. The golf club head of claim 1, wherein the multiple sandwiched core layers are connected.

4. The golf club head of claim 1, wherein the multiple sandwiched core layers comprise a material selected from a plastic polymer, an aluminum polymer, a foam, a resin impregnated paper, balsa wood, bucky paper, filled vinyl polymer, a visco elastic polymer, rubber, and cotton.

5. The golf club head of claim 1, wherein the multiple sandwiched core layers comprise honeycomb, hexagonal, trapezoidal, triangular, pyramidal, conical, cylindrical, spherical, rectangular or rhomboidal shapes.

6. The golf club of claim 1, wherein the multiple sandwiched core layers protrude into the cavity of the golf club head.

7. The golf club of claim 1, wherein the multiple sandwiched core layers have a uniform thickness.

8. The golf club of claim 1, wherein the multiple sandwiched core layers are placed toward the toe section, the leading edge, the trailing edge, on the crown, on the sole, or on the skirt.

* * * * *